US010915124B2

(12) United States Patent
Harada

(10) Patent No.: US 10,915,124 B2
(45) Date of Patent: Feb. 9, 2021

(54) VOLTAGE REGULATOR HAVING A PHASE COMPENSATION CIRCUIT

(71) Applicant: ABLIC Inc., Chiba (JP)

(72) Inventor: Noriyuki Harada, Chiba (JP)

(73) Assignee: ABLIC INC., Chiba (JP)

( * ) Notice: Subject to any disclaimer, the term of this patent is extended or adjusted under 35 U.S.C. 154(b) by 0 days.

(21) Appl. No.: 16/440,242

(22) Filed: Jun. 13, 2019

(65) Prior Publication Data

US 2020/0004284 A1 Jan. 2, 2020

(30) Foreign Application Priority Data

Jun. 27, 2018 (JP) ..... 2018-122105

(51) Int. Cl.
*G05F 1/575* (2006.01)
*G05F 1/59* (2006.01)

(52) U.S. Cl.
CPC ..... *G05F 1/575* (2013.01); *G05F 1/59* (2013.01)

(58) Field of Classification Search
CPC ... G05F 1/10; G05F 1/46; G05F 1/461; G05F 1/56; G05F 1/561; G05F 1/562; G05F 1/563; G05F 1/575; G05F 1/59; G05F 1/595; G05F 1/467; G05F 1/565; H02M 2001/0006; H02M 2001/0025; H02M 2001/0029; H02M 2001/0045; H02M 1/14; H02M 1/143; H02M 1/15; H02M 1/44; H02M 2001/0016; H02M 2001/0019; H02M 2001/0022
USPC ..... 323/222–226, 266, 268–275, 280, 323/282–285, 289, 304, 311, 312, 323/315–316, 351; 327/538–543; 330/291–297
See application file for complete search history.

(56) References Cited

U.S. PATENT DOCUMENTS 6,765,374 B1 * 7/2004 Yang ..... G05F 1/575 323/280
8,115,463 B2 * 2/2012 Wang ..... G05F 1/575 323/280

FOREIGN PATENT DOCUMENTS

JP 2002-032133 1/2002

OTHER PUBLICATIONS

English translation of JP 2002032133. (Year: 2002).*

* cited by examiner

*Primary Examiner* — Thienvu V Tran
*Assistant Examiner* — Carlos O Rivera-Perez
(74) *Attorney, Agent, or Firm* — Brinks Gilson & Lione

(57) ABSTRACT

A voltage regulator includes an output transistor, a voltage division circuit, an error amplifier, a phase compensation circuit connected between the output terminal and the output terminal of the voltage division circuit, and an auxiliary transistor having a source connected to the input terminal, a drain connected to the phase compensation circuit, and a gate connected to the output terminal of the error amplifier through an offset voltage source.

2 Claims, 3 Drawing Sheets

VOLTAGE REGULATOR HAVING A PHASE COMPENSATION CIRCUIT

RELATED APPLICATIONS

Priority is claimed on Japanese Patent Application No. 2018-122105, filed on Jun. 27, 2018, the content of which is incorporated herein by reference.

BACKGROUND OF THE INVENTION

1. Field of the Invention

The present invention relates to a voltage regulator, in particular, to a phase compensation circuit of a voltage regulator.

2. Description of the Related Art

FIG. 3 is a circuit diagram illustrating a conventional voltage regulator in related art.

As illustrated in, for example, Japanese Patent Application Laid-Open No. 2002-32133, the conventional voltage regulator 200 includes an error amplifier 21, a reference voltage source 22, an output transistor 23, a voltage division circuit 24, a resistor 25, a capacitor 26, an auxiliary transistor 27, an input terminal 101, and an output terminal 102.

The error amplifier 21 has an inverting input terminal to which an output terminal of the reference voltage source 22 is connected, and a non-inverting input terminal to which an output terminal of the voltage division circuit 24 is connected. The output transistor 23 has a source connected to the input terminal 101, a drain connected to the output terminal 102, and a gate connected to an output terminal of the error amplifier 21. The voltage division circuit 24 is connected between the output terminal 102 and a ground terminal 103.

The resistor 25 and the capacitor 26 are connected between the output terminal 102 and the output terminal of the voltage division circuit 24. The auxiliary transistor 27 has a source connected to the input terminal 101, a drain connected to a connecting point of the resistor 25 and the capacitor 26, and a gate connected to the output terminal of the error amplifier 21.

In the voltage regulator 200 having such a configuration as described above, a phase compensation circuit is constituted from the resistor 25, the capacitor 26, and the auxiliary transistor 27 and performs a phase compensation by feedback of a phase compensation signal generated by a current flowing through the auxiliary transistor 27 and the resistor 25 to the non-inverting input terminal of the error amplifier 21 through the capacitor 26 as a feedback signal.

In the voltage regulator 200, in order to obtain an expected phase compensation effect, the auxiliary transistor 27 should operate in a saturation region while the output transistor 23 operates in a saturation region. The auxiliary transistor 27 thus needs to have a source-drain voltage Vds greater than the overdrive voltage Vgs−Vth.

SUMMARY OF THE INVENTION

In the conventional voltage regulator, however, the source-drain voltage Vds of the auxiliary transistor 27 becomes a smaller value than the voltage between the input and output terminals by a voltage drop across the resistor 25. With a view to obtaining the expected phase compensation effect, the difference in voltage between the input and output terminals therefore needs to be made higher by the voltage drop across the resistor 25 to allow the auxiliary transistor 27 to operate in the saturation region, and a difficulty occurs in stable operation when the input/output voltage difference is small.

The present invention provides a voltage regulator having a phase compensation circuit which can operate stably even when an input/output voltage difference is small.

A voltage regulator according to one aspect of the present invention includes an output transistor having a source connected to an input terminal and a drain connected to an output terminal, a voltage division circuit connected between the output terminal and a ground terminal, an error amplifier having one input terminal to which an output terminal of the voltage division circuit is connected, the other input terminal to which an output terminal of a reference voltage source is connected, and an output terminal connected to a gate of the output transistor, a phase compensation circuit connected between the output terminal and the output terminal of the voltage division circuit, and an auxiliary transistor having a source connected to the input terminal, a drain connected to the phase compensation circuit, and a gate connected to the output terminal of the error amplifier through an offset voltage source.

According to a voltage regulator of the present invention, since an offset voltage source is provided at a gate of an auxiliary transistor constituting a phase compensation circuit, the phase compensation circuit can operate stably even when an input/output voltage difference is small.

DETAILED DESCRIPTION OF THE PREFERRED EMBODIMENTS

Figure 1:
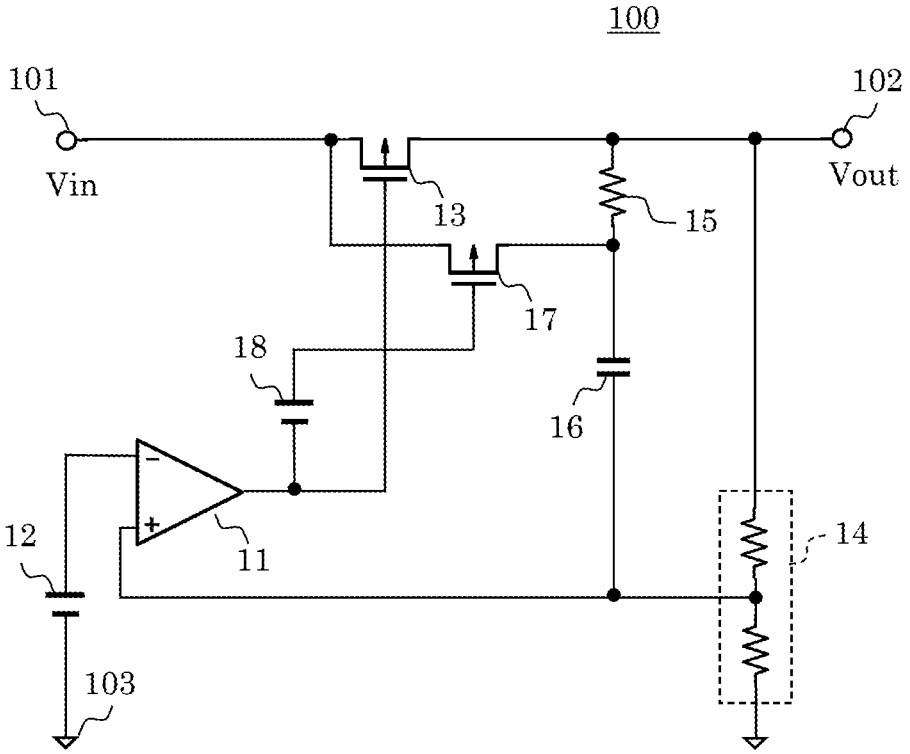
FIG. 1 is a circuit diagram illustrating a voltage regulator according to an embodiment of the present invention.

FIG. 1 is a circuit diagram illustrating a voltage regulator according to an embodiment of the present invention.

The voltage regulator 100 according to the embodiment includes an error amplifier 11, a reference voltage source 12, an output transistor 13, a voltage division circuit 14, a resistor 15, a capacitor 16, an auxiliary transistor 17, an offset voltage source 18, an input terminal 101, and an output terminal 102.

The error amplifier 11 has an inverting input terminal to which an output terminal of the reference voltage source 12 is connected, and a non-inverting input terminal to which an output terminal of the voltage division circuit 14 is connected. The output transistor 13 has a source connected to the input terminal 101, a drain connected to the output terminal 102, and a gate connected to an output terminal of the error amplifier 11. The voltage division circuit 14 is connected between the output terminal 102 and a ground terminal 103. The resistor 15 and the capacitor 16 are connected between the output terminal 102 and the output terminal of the voltage division circuit 14. The auxiliary transistor 17 has a source connected to the input terminal 101, and a drain connected to a connecting point of the resistor 15 and the capacitor 16. The offset voltage source 18 is connected between the output terminal of the error amplifier 11 and a gate of the auxiliary transistor 17.

The voltage regulator 100 compares a feedback voltage obtained by dividing an output voltage Vout of the output terminal 102 with the voltage division circuit 14 and a reference voltage of the reference voltage source 12 by the error amplifier 11 and controls a gate voltage of the output transistor 13 according to the comparison result, thereby holding the output voltage Vout of the output terminal 102 at a desired voltage.

The resistor 15, the capacitor 16, the offset voltage source 18, and the auxiliary transistor 17 constitute a phase compensation circuit. A phase compensation signal is generated by a current flowing through the auxiliary transistor 17, and the resistor 15. Phase-compensation of the error amplifier 11 is made by feedback of the phase compensation signal to the non-inverting input terminal of the error amplifier 11 through the capacitor 16.

A condition for operation of the output transistor 13 in the saturation region is given by Equation (1) when an input voltage is Vin, an output voltage is Vout, a threshold voltage is Vth, and a gate-source voltage is Vgs, respectively:

$$(Vin-Vout)\geq(Vgs-Vth) \quad (1)$$

Similarly, a condition for operation of the auxiliary transistor 17 in the saturation region is given by Equation (2) when an offset voltage of the offset voltage source 18 is ΔVos, a threshold voltage is Vth, the resistance value of the resistor 15 is Rm, and a current flowing through the resistor 15 is Im, respectively:

$$(Vin-Vout-Im\times Rm)\geq(Vgs-\Delta Vos-Vth) \quad (2)$$

Setting the offset voltage ΔVos to be equal to or higher than the voltage drop (Im×Rm) across the resistor 15 from Equations (1) and (2) enables the auxiliary transistor to operate in the saturation region under the difference between the input and output voltages of the auxiliary transistor which is similar to that of the output transistor. The phase compensation circuit is therefore capable of obtaining a desired phase compensation effect under a condition of wider input/output voltages.

Figure 2:
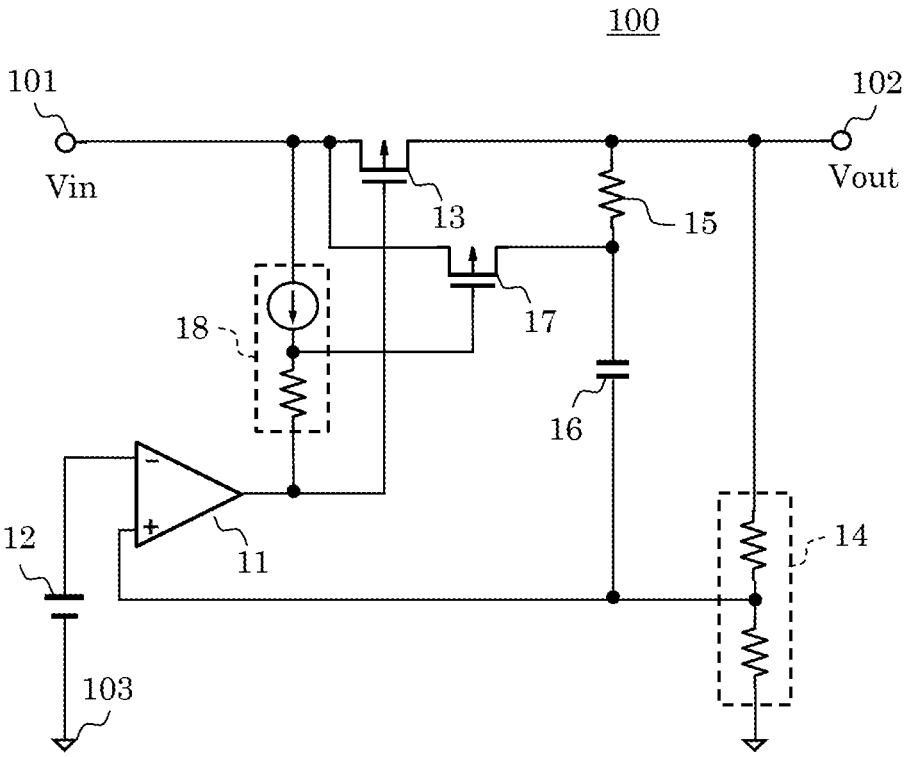
FIG. 2 is a circuit diagram illustrating an example of a phase compensation circuit of the voltage regulator according to the embodiment of the present invention.
Figure 3:
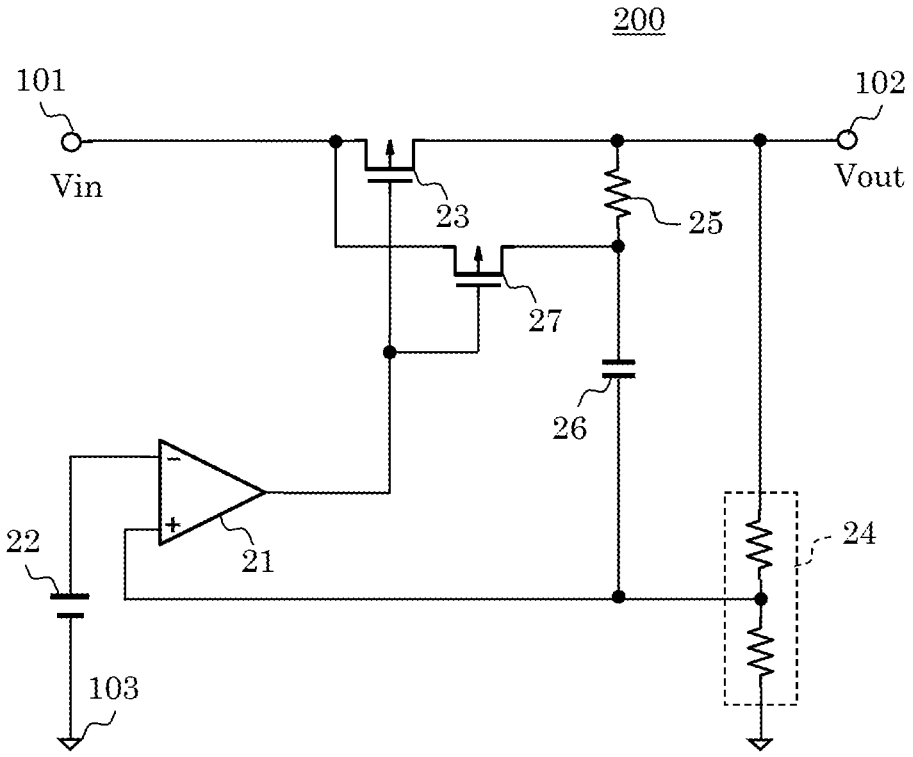
RELATED ART FIG. 3
FIG. 3 is a circuit diagram illustrating a conventional voltage regulator in related art.

FIG. 2 is a circuit diagram illustrating an example of the offset voltage source 18 in the phase compensation circuit of the voltage regulator according to the embodiment of the present invention.

The offset voltage source 18 is constituted using a current source and a resistor connected in series between the input terminal 101 and the output terminal of the error amplifier 11. The offset voltage source 18 has an output terminal which is a connecting point of the current source and the resistor, and which is connected to the gate of the auxiliary transistor 17.

In the offset voltage source 18 such as illustrated in FIG. 2, an offset voltage ΔVos is given by Equation (3) when a current of the current source is Ib and a resistance of the resistor is Rb:

$$\Delta Vos=Ib\times Rb \quad (3)$$

The offset voltage source 18 constituted as illustrated in FIG. 2 allows the current of the current source and the resistance of the resistor to be adjusted by means such as trimming or the like to thereby enable the offset voltage ΔVos to take a desired value.

As described above, by the phase compensation circuit of the voltage regulator according to the embodiment of the present invention, it is possible to obtain a stable output voltage Vout because an expected phase compensation effect is obtained under a wider input/output voltage condition.

Incidentally, a similar effect is brought about even if a MOS transistor whose gate is biased by a constant voltage is used as the resistor of the offset voltage source 18. An offset voltage ΔVos in that case is given by Equation (4) when the ON resistance value of the transistor is Ron:

$$\Delta Vos=Ib\times Ron \quad (4)$$

Further, a similar effect is brought about even if a diode or a MOS transistor whose gate and source are made common is used as the resistor of the offset voltage source 18. An offset voltage ΔVos in that case is given by Equation (5) when the forward voltage of the diode is Vf:

$$\Delta Vos=Vf \quad (5)$$

What is claimed is:

1. A voltage regulator, comprising:

an output transistor having a source connected to an input terminal and a drain connected to an output terminal;

a voltage division circuit connected between the output terminal and a ground terminal, an output terminal between two resistors thereof;

an error amplifier having a first input terminal connected to the output terminal of the voltage division circuit, a second input terminal connected to an output terminal of a reference voltage source, and an output terminal connected to a gate of the output transistor; and a phase compensation circuit connected between the output terminal and the output terminal of the voltage division circuit, and comprising an offset voltage source, a resistor, a capacitor, and an auxiliary transistor, the auxiliary transistor having a source connected to the input terminal, a drain connected to the capacitor and to the resistor, and a gate connected to the output terminal of the error amplifier through the offset voltage source, wherein the offset voltage source provides an offset voltage that is equal to or higher than a voltage drop across the resistor, a phase compensation signal comprising a current flowing through the auxiliary transistor and the resistor and input to the first input terminal of the error amplifier.

2. The voltage regulator according to claim 1, wherein the offset voltage source comprises a resistive element supplied with a current from a current source.

* * * * *